US010138659B2

(12) United States Patent
Redondo Guerra et al.

(10) Patent No.: US 10,138,659 B2
(45) Date of Patent: Nov. 27, 2018

(54) COMPRESSION LATCH

(71) Applicant: Southco, Inc., Concordville, PA (US)

(72) Inventors: José María Redondo Guerra, Stuttgart (DE); Andrew James Thornton, Worcestershire (GB); Bernd Noatsch, Sindelfingen (DE)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 15/511,901

(22) PCT Filed: Sep. 16, 2015

(86) PCT No.: PCT/US2015/050368
§ 371 (c)(1),
(2) Date: Mar. 16, 2017

(87) PCT Pub. No.: WO2016/044385
PCT Pub. Date: Mar. 24, 2016

(65) Prior Publication Data

US 2017/0298666 A1 Oct. 19, 2017

Related U.S. Application Data

(60) Provisional application No. 62/051,481, filed on Sep. 17, 2014.

(51) Int. Cl.
*E05C 3/12* (2006.01)
*E05C 3/16* (2006.01)
(Continued)

(52) U.S. Cl.
CPC ..... *E05C 3/122* (2013.01); *E05B 5/00* (2013.01); *E05B 13/002* (2013.01);
(Continued)

(58) Field of Classification Search
CPC ... E05B 5/00; E05B 5/003; E05C 3/00; E05C 3/004; E05C 3/12; E05C 3/122; E05C 3/124; E05C 3/16; E05C 3/162
See application file for complete search history.

(56) References Cited

U.S. PATENT DOCUMENTS 2,944,848 A 7/1960 Mandolf
4,693,503 A * 9/1987 Bisbing ..... E05C 3/08 292/210
(Continued)

FOREIGN PATENT DOCUMENTS

CN 1816675 A 8/2006
CN 101084358 A 12/2007
(Continued)

OTHER PUBLICATIONS

International Search Report for International Application No. PCT/US2015/050368, dated Jan. 21, 2016, 2 pages.
(Continued)

*Primary Examiner* — Christopher J Boswell
(74) *Attorney, Agent, or Firm* — RatnerPrestia

(57) ABSTRACT

A compression latch assembly for latching a panel to a frame includes a housing assembly, a lockplug assembly, a handle actuator assembly, and a rotating pawl assembly. The housing assembly defines an exterior well and a first and second compartment. The lockplug assembly resides within the first compartment and includes a lockplug having a circumferential guide surface. The handle actuator assembly has a handle within the exterior well, a crank coupled to the handle, and a drive shaft coupled to the crank. The handle and the crank rotate about common pivot point within the second compartment. The handle is selectively captured and ejected by interaction between the circumferential guide surface and a locking pin on the handle. The rotating pawl assembly has a hook defining a slot that receives the drive
(Continued)

shaft. Pivotal movement of the handle actuates the hook by movement of the drive shaft within the slot.

20 Claims, 14 Drawing Sheets

(51) Int. Cl.

| | |
|---|---|
| ***E05B 5/00*** | (2006.01) |
| ***E05B 35/00*** | (2006.01) |
| ***E05C 19/14*** | (2006.01) |
| ***E05B 13/00*** | (2006.01) |
| ***E05B 17/00*** | (2006.01) |
| ***E05C 3/00*** | (2006.01) |
| ***E05C 19/12*** | (2006.01) |

(52) U.S. Cl.
CPC ..... *E05B 17/002* (2013.01); *E05B 17/0025* (2013.01); *E05B 35/008* (2013.01); *E05C 3/004* (2013.01); *E05C 3/162* (2013.01); *E05C 19/12* (2013.01); *E05C 19/145* (2013.01)

(56) References Cited

U.S. PATENT DOCUMENTS

| | | | | |
|---|---|---|---|---|
| 5,267,762 | A * | 12/1993 | Gromotka | E05B 5/003 292/113 |
| 5,638,709 | A * | 6/1997 | Clavin | E05B 13/002 292/229 |
| 6,343,815 | B1 | 2/2002 | Poe | |
| 6,513,841 | B1 * | 2/2003 | Jackson | B64D 29/06 292/126 |
| 6,913,297 | B2 * | 7/2005 | Jackson | E05B 1/0092 292/195 |
| 7,461,871 | B2 | 12/2008 | Vauchel | |
| D585,725 | S | 2/2009 | Le et al. | |
| 8,016,329 | B2 | 9/2011 | Johansson et al. | |
| 8,136,850 | B2 * | 3/2012 | Wollacott | E05C 3/162 292/173 |
| 8,646,819 | B2 * | 2/2014 | Do | B64D 29/06 292/228 |
| 8,770,635 | B2 | 7/2014 | Schwickerath et al. | |
| 8,857,230 | B1 * | 10/2014 | Misner | E05B 83/18 292/229 |
| 8,991,228 | B2 * | 3/2015 | Yang | E05B 65/006 292/336.3 |
| 9,140,041 | B2 * | 9/2015 | Wollacott | E05C 3/006 |
| 2006/0138785 | A1 | 6/2006 | Vauchel | |
| 2006/0138787 | A1 * | 6/2006 | Ramsauer | E05B 5/003 292/194 |
| 2012/0267904 | A1 | 10/2012 | Schwickerath et al. | |
| 2013/0328328 | A1 | 12/2013 | Leslie et al. | |
| 2014/0333074 | A1 * | 11/2014 | Wollacott | E05C 3/006 292/202 |

FOREIGN PATENT DOCUMENTS

| | | | |
|---|---|---|---|
| CN | 101230771 | A | 7/2008 |
| CN | 101568695 | A | 10/2009 |
| FR | 2857400 | A1 | 1/2005 |
| WO | 2006005050 | A2 | 1/2006 |
| WO | 2013119614 | A1 | 8/2013 |

OTHER PUBLICATIONS

International Preliminary Report on Patentability and Written Opinion for International Application No. PCT/US2015/050368, dated Mar. 21, 2017, 9 pages.

Chinese Office Action for Chinese Application No. 201580050178.X, dated Jan. 17, 2018 with translation, 9 pages.

Partial Supplementary European Search Report for European Application No. 15 841 958.0, dated Jun. 13, 2018, 12 pages.

Extended European Search Report for European Application No. 15841958.0, dated Sep. 13, 2018, 10 pages.

Communication Pursuant to Rules 70(2) and 70a(2) EPC for European Application No. 15841958.0, dated Oct. 2, 2018, 1 page.

* cited by examiner

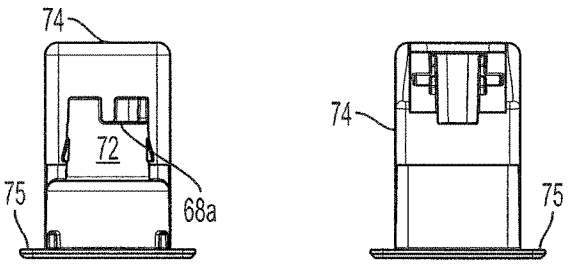
FIG. 5D
FIG. 5E
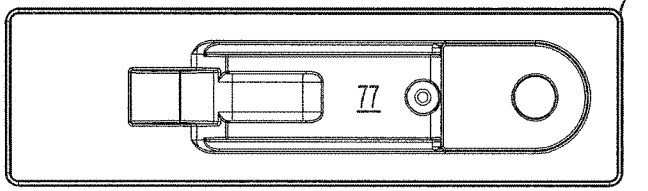
FIG. 5F
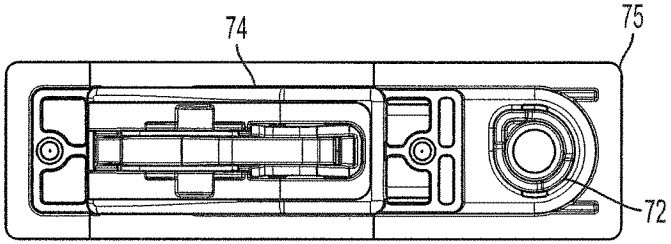
FIG. 5G
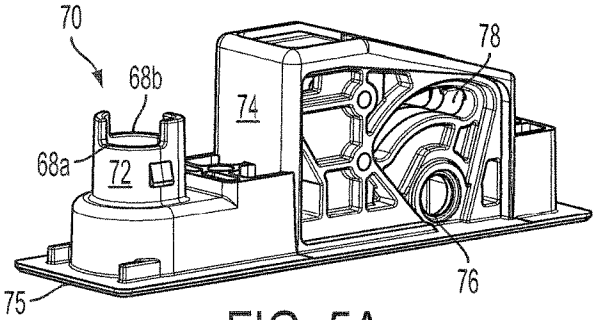
FIG. 5A
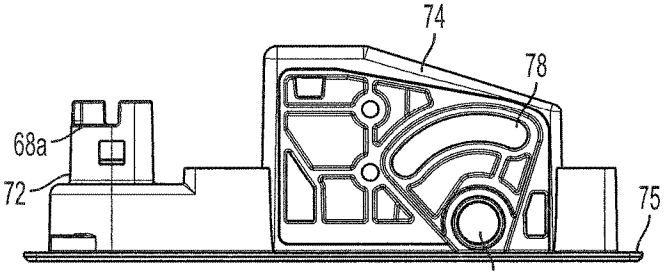
FIG. 5B
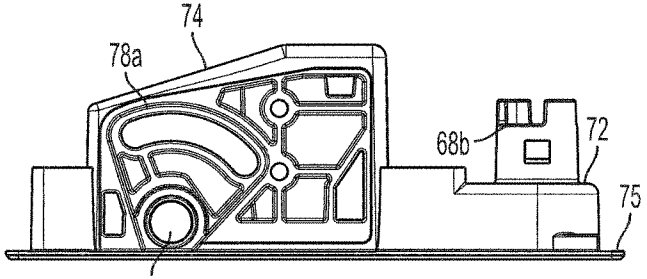
FIG. 5C

COMPRESSION LATCH

CROSS-REFERENCE TO RELATED APPLICATIONS

This application is a U.S. National Phase Application of PCT International Application PCT/US2015/050368, filed Sep. 16, 2015, claiming the benefit of priority of U.S. Provisional Application No. 62/051,481, filed Sep. 17, 2014, the contents of which are incorporated herein by reference in their entirety for all purposes.

FIELD OF THE INVENTION

The present invention relates generally to a compression latch for selectively maintaining a panel or door in a closed position relative to a doorframe or the like.

BACKGROUND OF THE INVENTION

In many applications the need arises to selectively maintain a panel or door in a closed position relative to a doorframe or the like, while developing a compressive force between the door or panel and the doorframe. For example, when a gasket is used to provide a seal between a door and a doorframe when the door is closed, it is desirable for the latch holding the door closed to provide a compressive force to compress the gasket between the door and the doorframe to effectively seal any gap or seam between the door and doorframe. Latches that develop this type of compressive force between the door and doorframe are typically known as compression latches.

Compression latches are sometimes incorporated in panel or doors that are exposed to severe ambient conditions. In some instances, the accumulation of water, ice, and debris within the latching mechanism impairs the functioning of the compression latch. Therefore, in certain applications, it is desirable to have a compression latch that is sealed and rugged, such that the compression latch remains operational.

Accordingly, there remains a need for improvements in compression latches in terms of at least one of performance, reliability, durability, and/or cost.

SUMMARY OF THE INVENTION

In one aspect of the present invention, a compression latch assembly is configured for latching a panel separating an interior region from an exterior region. The compression latch assembly comprises a housing assembly, a handle actuator assembly, and a rotating pawl assembly. The housing assembly defines an exterior well open to the exterior region and a compartment extending into the interior region. The handle actuator assembly has a handle exposed within the exterior well of the housing assembly, a crank coupled to the handle, and a drive shaft coupled to the crank, wherein the handle and the crank rotate about a pivot point within the compartment of the housing assembly to move the drive shaft. The rotating pawl assembly has a hook defining a slot positioned to receive the drive shaft of the handle actuator assembly, wherein pivotal movement of the handle of the handle actuator assembly with respect to the pivot point actuates the hook by movement of the drive shaft of the handle actuator assembly within the slot defined in the hook.

In another aspect of the present invention, the compression latch assembly further comprises second compartment in the housing assembly and a lockplug assembly is positioned within the second compartment. The lockplug assembly includes a lockplug configured to selectively capture and eject the handle.

In yet another aspect of the present invention, a compression latch assembly installed in a panel comprises a rotating pawl assembly that includes a hook having an extension. When the panel is slammed shut by a user, the extension contacts a strike plate installed on the frame surrounding the panel and urges the hook towards the strike plate.

BRIEF DESCRIPTION OF THE DRAWING

FIG. 5A shows a perspective view of a housing of the compression latch assembly illustrated in FIG. 1A;

FIG. 5B shows a left side view of the housing of FIG. 5A;

FIG. 5C shows a right side view of the housing of FIG. 5A;

FIG. 5D shows a rear view of the housing of FIG. 5A;

FIG. 5E shows a front view of the housing of FIG. 5A;

FIG. 5F shows a bottom view of the housing of FIG. 5A;

FIG. 5G shows a top view of the housing of FIG. 5A;

DETAILED DESCRIPTION OF THE INVENTION

Figure 1A:
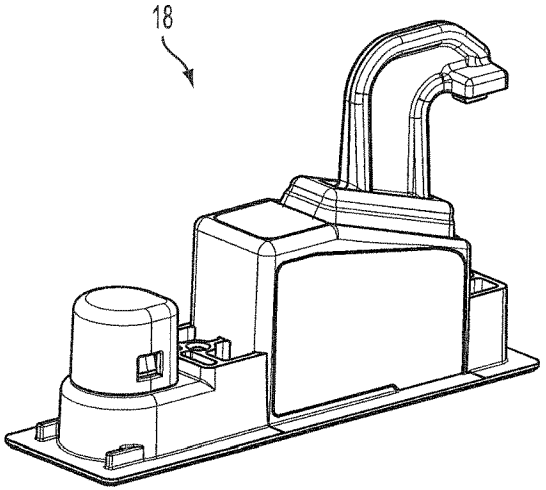
FIG. 1A shows perspective view of a first embodiment of a compression latch assembly according to the invention.

The invention will now be described by reference to exemplary embodiments and variations of those embodiments. Although the invention is illustrated and described herein with reference to specific embodiments, the invention is not intended to be limited to the details shown and described. Rather, various modifications may be made in the details within the scope and range of equivalents of the claims and without departing from the invention.

Referring generally to the Figures, one aspect of the present invention provides a compression latch assembly (18) configured for latching a panel separating an interior region from an exterior region. The compression latch assembly (18) comprises a housing assembly, a lockplug assembly, a handle actuator assembly, and a rotating pawl assembly.

The housing assembly defines an exterior well (77) open to the exterior region and a first compartment (72) and a second compartment (74) extending into the interior region. The housing assembly may be provided with various seals, such as O-rings (37, 59*a*, 59*b*) or caps (82) and covers (71*a* and 71*b*), to prevent the ingress of liquid or debris into the internal compartments of the housing (70).

The lockplug assembly resides within the first compartment (72) and includes a lockplug (30) that may be biased towards a locking position. The lockplug (30) may include a circumferential guide surface and a lockplug driver (31) having at least one of a male projection and a female recess. The compression latch assembly may then be provided in combination with a tool, such as a key, configured to mate with the at least one male projection and/or female recess of the lockplug driver (31) for manual rotation of the lockplug (30).

The handle actuator assembly has a handle (50) exposed within the exterior well (77) of the housing assembly, a locking pin (54) extending from a surface of the handle (50), at least one crank (58*a* and 58*b*) coupled to the handle (50), and a drive shaft (60) coupled to the crank. The handle (50) and crank (50) may be integral or comprise two or more coupled pieces and are configured to rotate about a common pivot point (110) within the second compartment (74) of the housing assembly causing the drive shaft (60) to move. The handle (50) may also be selectively captured and ejected by interaction between the circumferential guide surface of the lockplug (30) and the locking pin (54) extending from the surface of the handle (50).

The rotating pawl assembly has a hook (20) defining a slot (28*a*) positioned to receive the drive shaft (60) of the handle actuator assembly. Pivotal movement of the handle (50) with respect to the pivot point actuates the hook (20) by movement of the drive shaft (60) within the slot (28*a*). The hook (20) may also include a shoulder (22) shrouded with a compressible gasket (24). The compressible gasket (24) may bear against an exterior surface of a housing box (80) of the housing assembly when the compression latch assembly is in a latched condition.

In another aspect of the present invention, the compression latch assembly may be provided with mounting hardware, such as a gasket (90) and U-brackets (92*a* and 92*b*) that may be fastened to the housing (70) of the compression latch assembly. The gasket (90) and U-brackets (92*a* and 92*b*) allow for a sealed installation of the compression latch assembly in the opening of a panel.

In yet another aspect of the present invention, the hook (20) of the compression latch assembly may be provided with an extension (23). The extension (23) is configured to contact a strike plate (100) that may be installed on the frame surrounding the panel on which the compression latch assembly is mounted. When the panel is swung from an exterior (open) region toward an interior (closed) region, contact with the strike plate (100) urges the hook (20) to rotate towards the strike plate (100).

Figure 4:
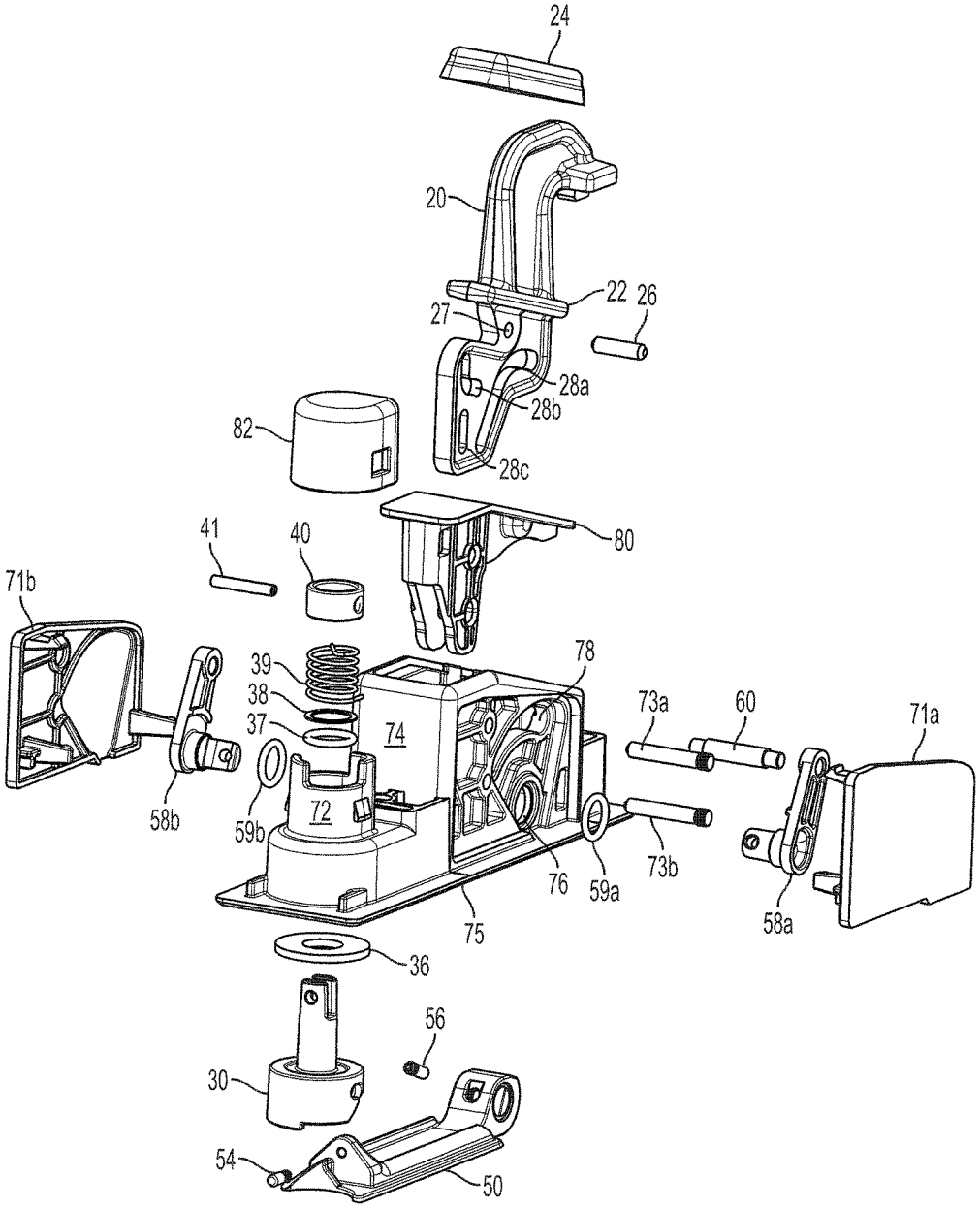
FIG. 4 shows an exploded view of the compression latch assembly illustrated in FIG. 1A.

Referring now to each of the figures more specifically, wherein like reference numerals used in the figures denote like parts throughout the various figures, in FIG. 1A one embodiment of the present invention is provided in the form of a latch assembly (18) comprising four assemblies: a rotating pawl assembly, a lockplug assembly, a handle actuator assembly, and a housing assembly. The embodiment of FIG. 1A is illustrated in an exploded view of FIG. 4 demonstrating the various components of the four assemblies. The various components of the latch assembly (18) are preferably constrained together and operate as one unit.

The rotating pawl assembly may include a hook (20) having a shoulder (22) around which a compression gasket (24) is applied, and a centering pin (26) inserted through a bore (27). Referring to FIGS. 9A to 9D, a portion of the hook (20) on one side of the shoulder (22) may define one or more slots that include a primary guide slot (28*a*) and two secondary guide slots (28*b* and 28*c*) used to guide the movement of the hook through a combination of rotational and linear movement, as will be described in greater detail below. The portion of the hook (20) defining the slots (28*a*, 28*b*, and 28*c*) may remain within the housing (70) assembly during operation, while the portion of the hook (20) on the opposite side of the shoulder (22) remains exposed.

The lockplug assembly may include a lockplug (30) (as seen in FIGS. 6A to 6E) having a tail section (32) inserted, first, through the center of a wear washer (36), then, an opening in a first compartment (72) of the housing(70), an O-ring (37), a washer (38), a torsion spring (39), and finally, a bearing (40). The tail section (32) may be captivated within the bearing (40) with a pin (41) inserted through holes located in the sides of the bearing (40) and the end of the tail section (32). The lockplug assembly may rotate about a center longitudinal axis. The pin (41) may also span across two cutouts (68*a*, 68*b*) in the first compartment (72) of the housing (70) (as seen in FIG. 5A to 5D). The sides of the cutouts (68*a* and 68*b*) provide stops, which may limit rotation of the locking assembly to about 90 degrees, for example. One end of the torsion spring (39) may be attached to the bearing (40) while the opposite end may be attached to the interior of the first compartment (72), such that upon rotation of the lockplug (30), the torsion spring (39) will strain. The stored energy will return the lockplug assembly to its original position upon releasing the lockplug (30).

Figure 8D:
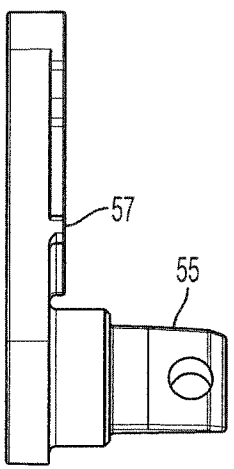
FIG. 8D shows a front view of the crank of FIG. 8A.
Figure 8C:
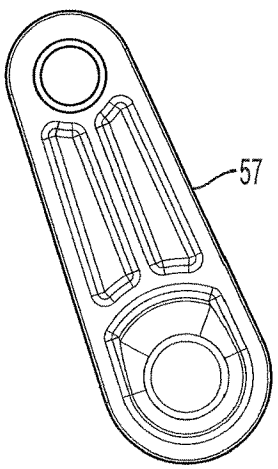
FIG. 8C shows a left side view of the crank of FIG. 8A.
Figure 8B:
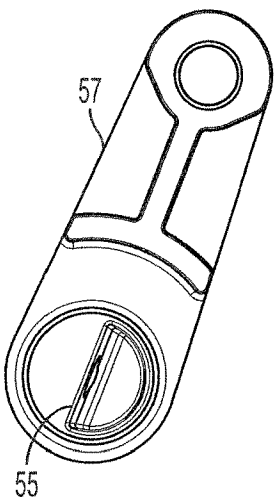
FIG. 8B shows a right side view of the crank of FIG. 8A.
Figure 8A:
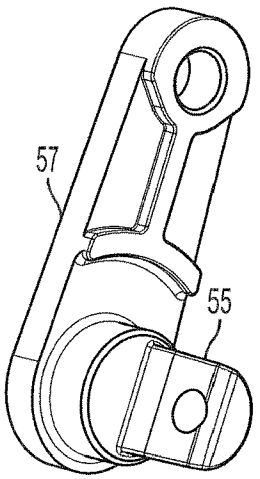
FIG. 8A shows a perspective view of a crank of the compression latch assembly illustrated in FIG. 1A.
Figure 9D:
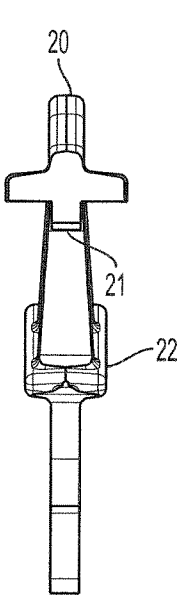
FIG. 9D shows a front view of the hook of FIG. 9A.
Figure 9C:
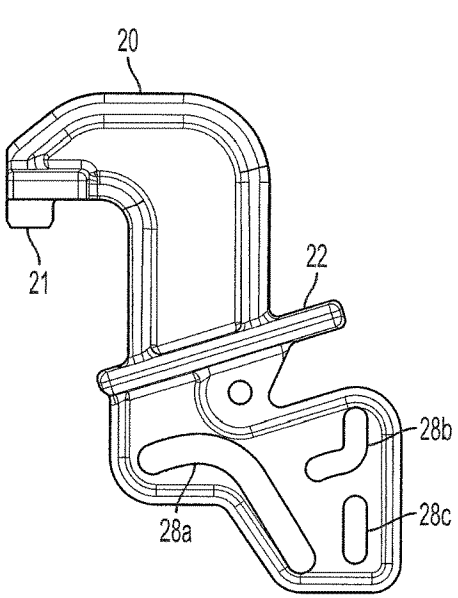
FIG. 9C shows a right side view of the hook of FIG. 9A.
Figure 9B:
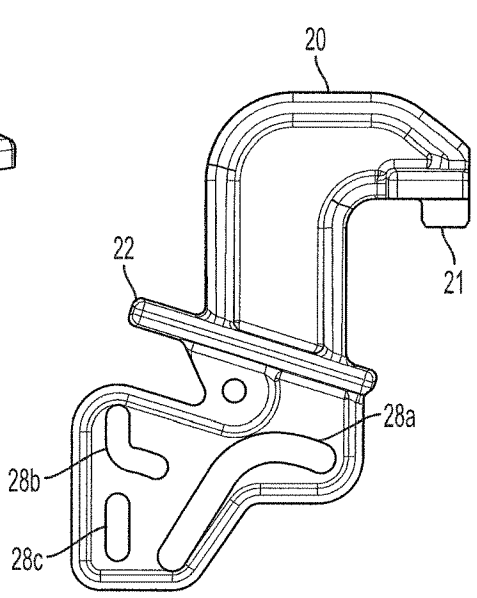
FIG. 9B shows a left side view of the hook of FIG. 9A.
Figure 9A:
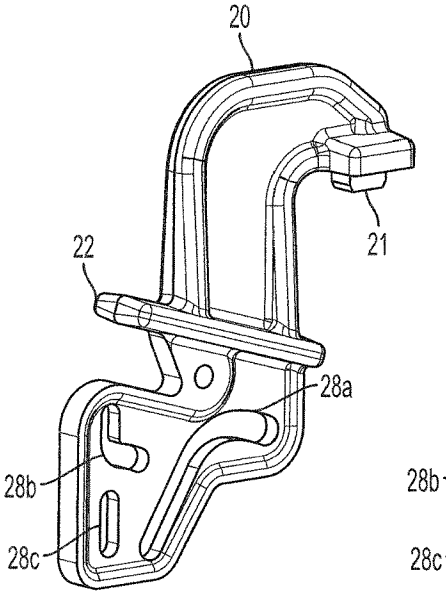
FIG. 9A shows a perspective view of a hook of the compression latch assembly illustrated in FIG. 1A.
Figure 10A:
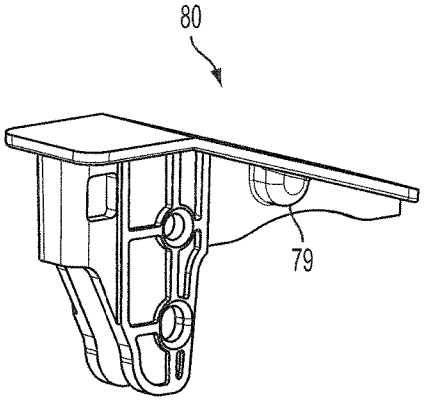
FIG. 10A shows a perspective view of a housing box of the compression latch assembly illustrated in FIG. 1A.
Figure 10B:
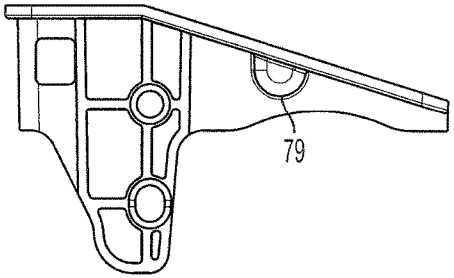
FIG. 10B shows a left side view of the housing box of FIG. 10A.
Figure 10C:
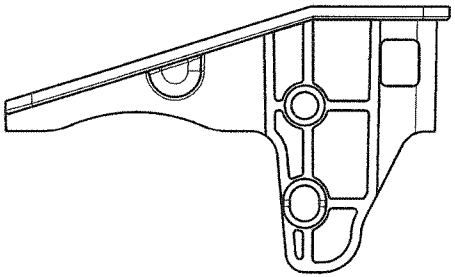
FIG. 10C shows a right side view of the housing box of FIG. 10A.
Figure 10D:
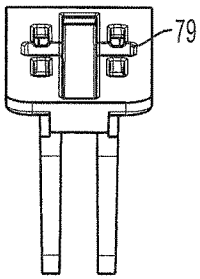
FIG. 10D shows a front view of the housing box of FIG. 10A.

The handle actuator assembly may include a handle (50), a locking pin (54), a handle pin (56), two cranks (58*a* and 58*b*), two O-rings (59*a* and 59*b*) and a drive shaft (60). The drive shaft (60) may be inserted through an arced slot (78) in the second compartment (74) of the housing (70), and opposite ends of the drive shaft are coupled to one crank (58*a*, 58*b*). One end of each crank (58*a* and 58*b*), preferably the end opposite to the attachment point with the drive shaft (60), may be inserted through an access hole (76) in the second compartment (74) and into one semicircular bore (52*a*, 52*b*) on one side of an end of the handle (50). The cranks (58*a* and 58*b*) may rotate with the handle (50) about a common pivot point (110) due to a bearing surface (55), as illustrated in FIGS. 8A, 8B and 8D, when inserted into the semicircular bores (52*a*, 52*b*) having a corresponding profile. Each crank (58*a* and 58*b*) may include an arm (57), and the bearing surface (55) may be located on one end of the arm (57) while a hole for accommodating the drive shaft (60) is provided on the opposite end of the arm (57). The cranks (58*a* and 58*b*) may then be coupled to the handle (50) by inserting the handle pin (56) through the handle (50) and both cranks (58*a* and 58*b*). When actuated, the handle (50), locking pin (54), cranks (58*a* and 58*b*), and drive shaft (60) may rotate together about the common pivot point (110), but the movement may be limited by the ends of the arced slot (78) in which the drive shaft (60) travels.

The housing assembly may include a housing (70) (in FIGS. 5A to 5G) having a first compartment (72) for housing the lockplug assembly that is covered with a lockplug cap (82), a second compartment (74) for housing a portion of the handle actuator and rotating pawl assemblies, and an exterior well (77) to allow access to the handle (50) and lockplug (30) by a user. The housing assembly may also include side covers (71*a* and 71*b*), a housing box (80), and two knurled pin guides (73*a* and 73*b*). The components within the housing assembly may not move as a result of actuation of the handle (50), but instead assist in controlling movement of the remaining assemblies. The housing box (80) may be inserted into the second compartment (74) of the housing (70), and the hook (20) may then be inserted through an opening in the housing box (80). The opening of the housing box (80) may include a cradle (79) for the centering pin (26), and the housing box (80) and hook (20) may be coupled to the housing (70) by inserting the knurled pin guides (73*a* and 73*b*) through the housing (70), the housing box (80), and the secondary guide slots (28*b* and 28*c*) defined by the hook (20). The drive shaft (60) may then be inserted through the arced slot (78) of the housing, as well as the primary guide slot (28*a*) of the hook.

Figure 1B:
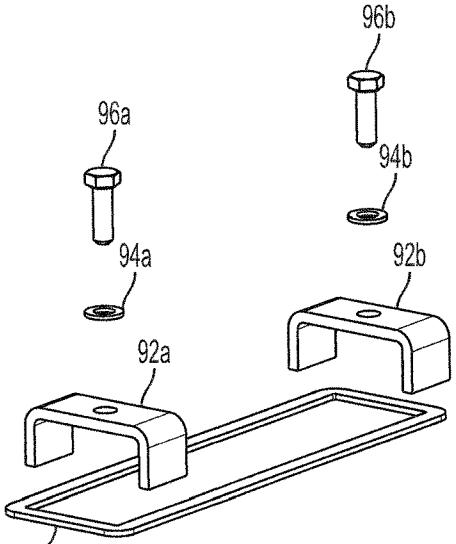
FIG. 1B shows a perspective view of mounting hardware that may be combined with the compression latch assembly illustrated in FIG. 1A.
Figure 1C:
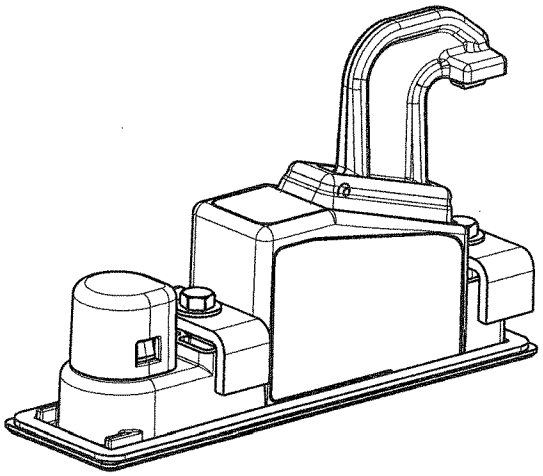
FIG. 1C shows a perspective view of the compression latch assembly illustrated in FIG. 1A combined with the mounting hardware of FIG. 1B.
Figure 2:
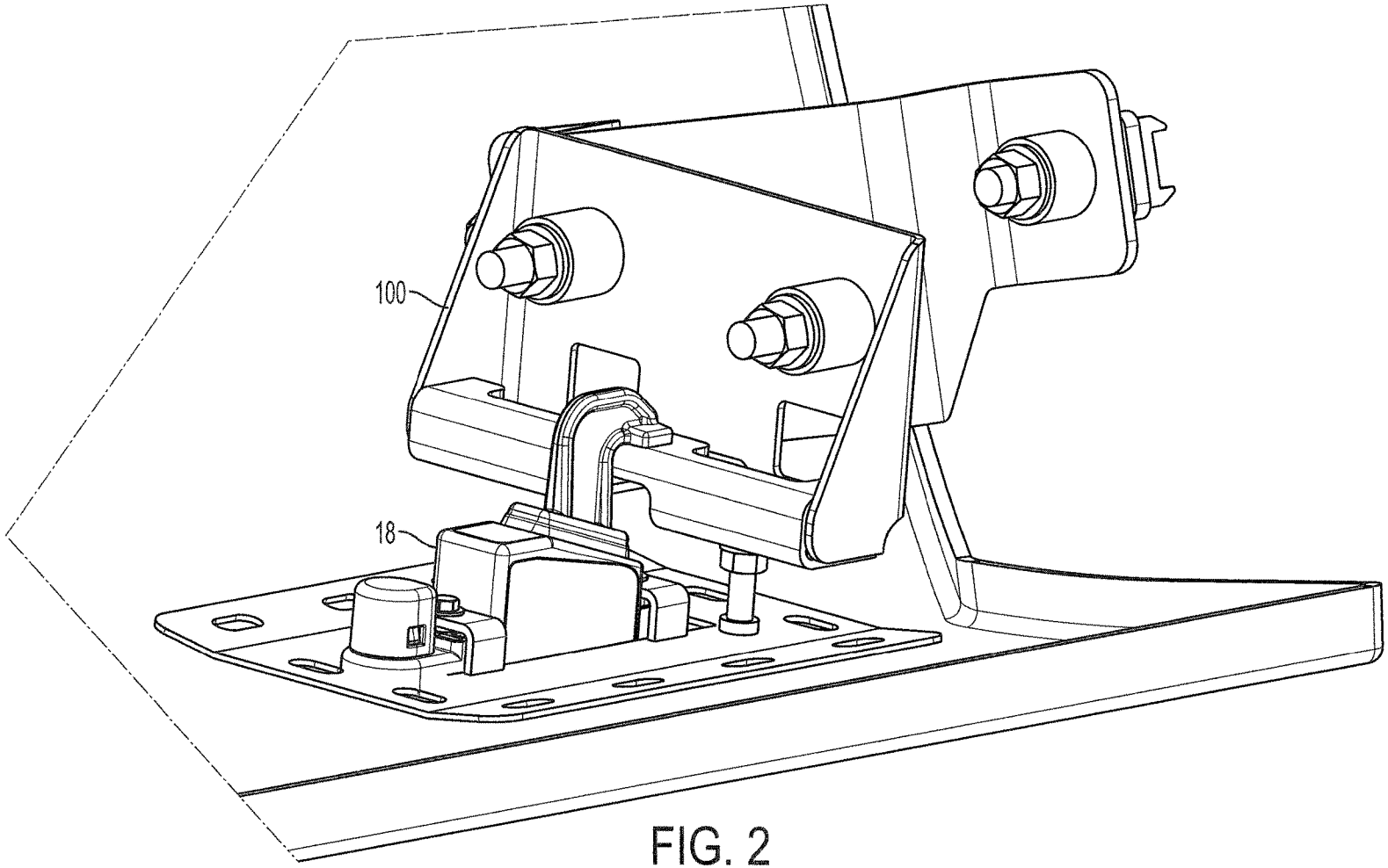
FIG. 2 shows a perspective view of the compression latch assembly and mounting hardware illustrated in FIG. 1C in the installed condition.
Figure 3A:
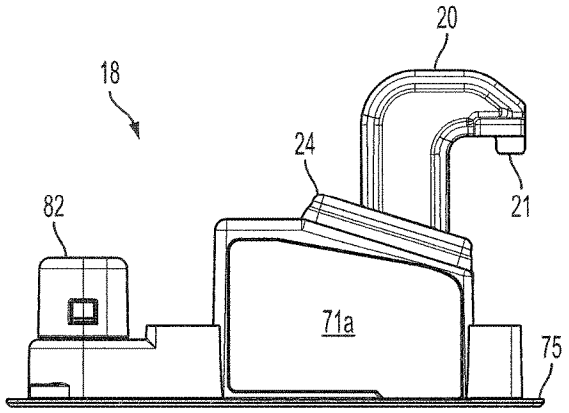
FIG. 3A shows a left side view of the compression latch assembly illustrated in FIG. 1A.
Figure 3B:
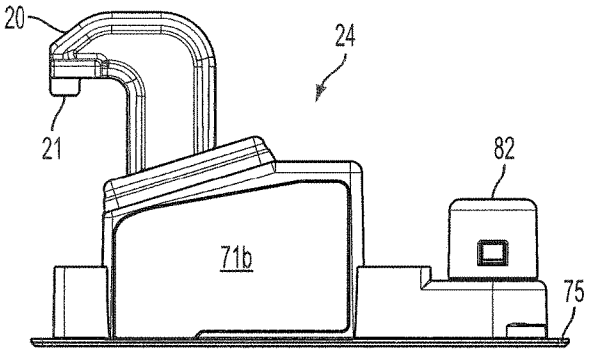
FIG. 3B shows a right side view of the compression latch assembly illustrated in FIG. 1A.
Figure 3C:
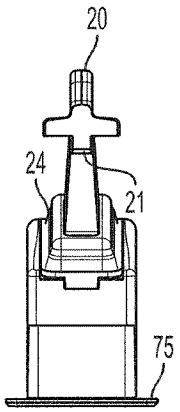
FIG. 3C shows a front view of the compression latch assembly illustrated in FIG. 1A.
Figure 3D:
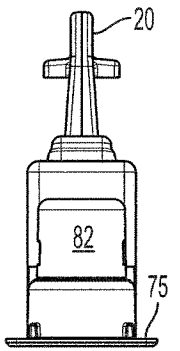
FIG. 3D shows a rear view of the compression latch assembly illustrated in FIG. 1A.
Figure 3E:
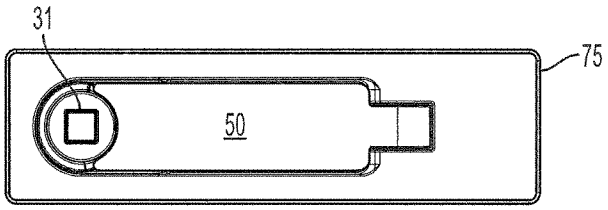
FIG. 3E shows a bottom view of the compression latch assembly illustrated in FIG. 1A.
Figure 3F:
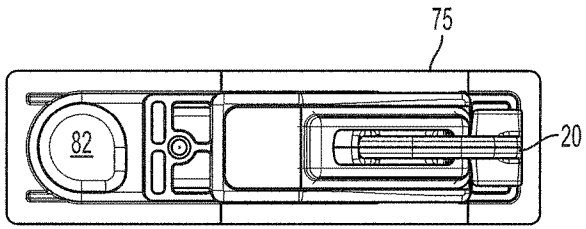
FIG. 3F shows a top view of the compression latch assembly illustrated in FIG. 1A.

A latch according to one embodiment of the present invention may be provided in combination with mounting hardware used to attach the latch to a panel, such as a door panel. Referring to FIG. 1B, the hardware, for example, may include two screws (96*a* and 96*b*), two washers (94*a* and 94*b*), two U-brackets (92*a* and 92*b*), and a gasket (90). The latch may be installed into a rectangular cut-out in a door panel having a length and width that is less than the length and width of a housing flange (75) of the housing (70). Prior to inserting the latch through the door panel, the gasket (90) may be placed around the latch body and rests on one side of the housing flange (75). The latch may then be inserted from the exterior side of the door panel through the rectangular cut-out, and the housing flange (75) prevents the latch from passing fully through resulting in the gasket (90) sitting between the door panel and the latch. To mount the latch to the panel, each of the two screws (96*a* and 96*b*) may be inserted through a washer (94*a* or 94*b*), a U-brackets (92*a* or 92*b*) before threading the screws into corresponding tapped holes on the housing (70). Tightening the screws (96*a* and 96*b*) clamps the latch to the panel through the U-brackets (92*a* and 92*b*), as illustrated in FIG. 2. The U-brackets (92*a* and 92*b*) bear on the interior surface of the panel compressing the gasket (90) and seal the outside environment from the interior side of the door panel.

Figure 12A:
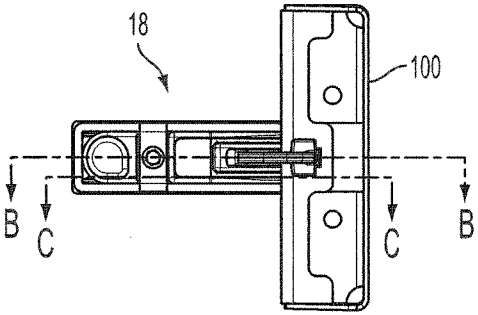
FIG. 12A shows an overhead plan view of the compression latch assembly illustrated in FIG. 1A in combination with a striker plate in a latched condition.
Figure 12B:
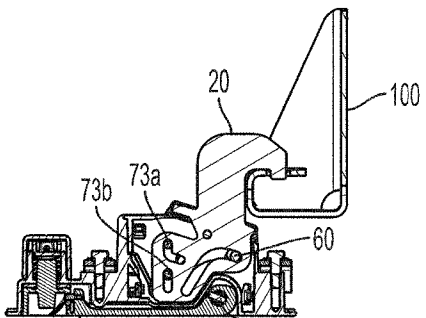
FIG. 12B shows a cross-sectional side view of the compression latch assembly and striker plate of FIG. 12A along line B-B.
Figure 12C:
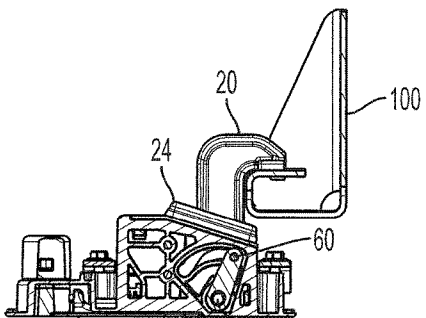
FIG. 12C shows a cross-sectional side view of the compression latch assembly and striker plate of FIG. 12A along line C-C.

A latch according to another embodiment of the invention may be provided in combination with a striker plate. When operated, the latch may act on a striker plate mounted to the frame surrounding the panel to secure the panel in a closed position. Various forms of striker plates known to those having skill in the art may be used with a latch according to the present invention, as long as the rotating pawl assembly can effectively engage the striker plate. For example, the striker plate may be provided in the form of a flat plate or an adjustable plate, such as the striker plate (100) illustrated in FIG. 2. In another embodiment of the invention, the striker plate (100) may include a hole with which a nose (21) of the hook (20) may mate, as illustrated in FIG. 12B, and further constrain the motion of the latch.

Figure 6C:
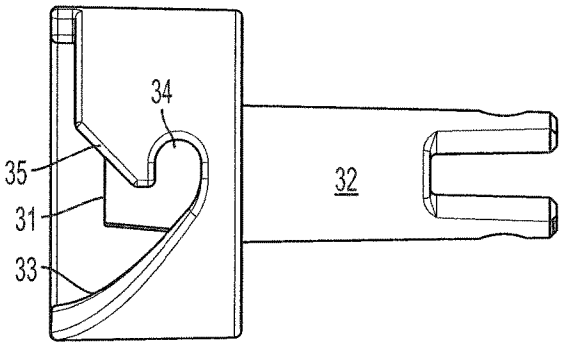
FIG. 6C shows a right side view of the lockplug of FIG. 6A.
Figure 6E:
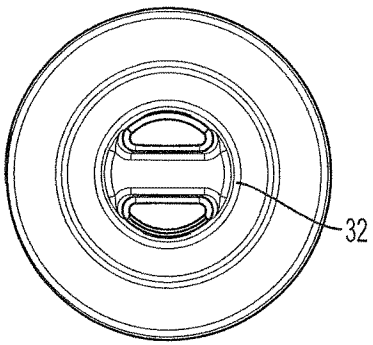
FIG. 6E shows a bottom view of the lockplug of FIG. 6A.
Figure 6D:
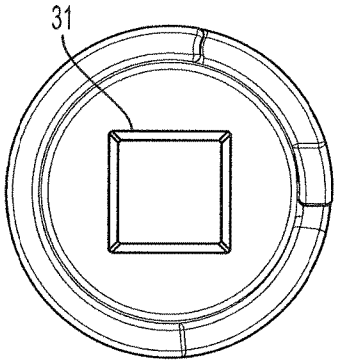
FIG. 6D shows a top view of the lockplug of FIG. 6A.
Figure 6A:
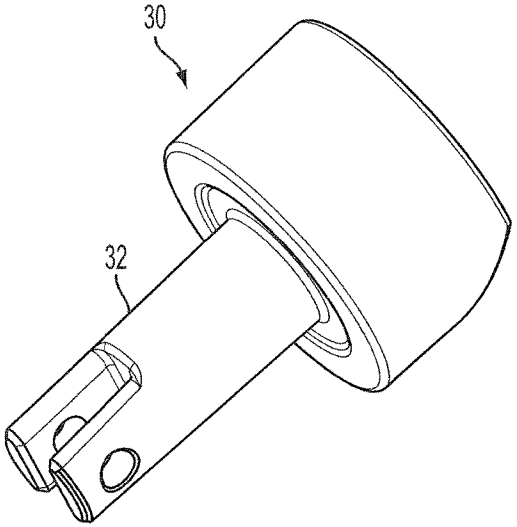
FIG. 6A shows a perspective view of a lockplug of the compression latch assembly illustrated in FIG. 1A.
Figure 6B:
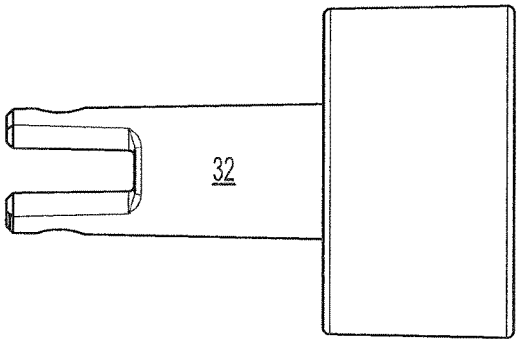
FIG. 6B shows a left side view of the lockplug of FIG. 6A.

Various embodiments of a latch according to the present invention may be operated by first releasing the handle (50)

from the lockplug (30) to enable a user to grasp and pull the handle (50). In one embodiment the lockplug (30) may include a lockplug driver (31) in the form of a 'male' projection with a particular shape, such as a square, as illustrated in FIG. 6D. A user may then use a tool, such as a key having a corresponding square-shaped 'female' recess, to rotate the lockplug driver (31). As will be understood by those having skill in the art, various shapes may be employed for the lockplug driver (31) and corresponding recess, such as a double-bit, a triangle, a tube, a slot, a hex, or a railway, and the location of the projection and recess may be reversed, i.e. the lockplug driver may be provided with the 'female' recess while the key is provided with a 'male' projection having the corresponding shape.

In one embodiment of the invention, the lockplug driver (31) may be rotated counter-clockwise to release the handle (50) from a secured position. Referring to FIGS. 6C and 11A to 11D, the lockplug driver (31) includes a groove on its circumferential surface comprising a plurality of portions, such as a captive notch (34), a cam face (33), and a ramp (35). Each portion of the groove provides a surface which may interact with the locking pin (54) of the handle (50).

Figure 11B:
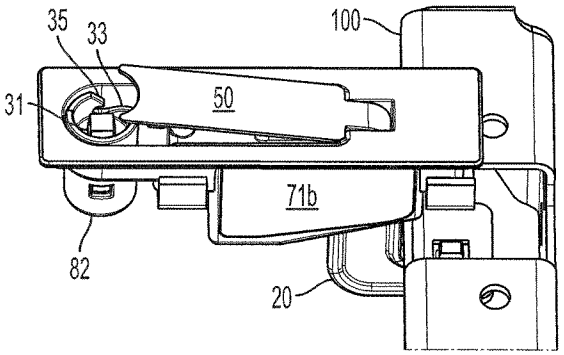
FIG. 11B shows a perspective view of the exposed face of the compression latch assembly illustrated in FIG. 1A in combination with a striker plate in which the handle is in a released condition and the lockplug is rotated counterclockwise.
Figure 11A:
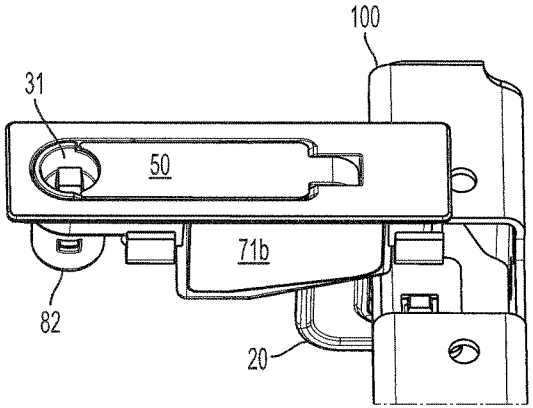
FIG. 11A shows a perspective view of the exposed face of the compression latch assembly illustrated in FIG. 1A in combination with a striker plate in a latched condition.

In the initial position, such as the state of the latch illustrated in FIG. 11A, the locking pin (54) extending from a surface (53) of the handle (50) is located within the captive notch (34) of the circumferential groove. Turning the lockplug driver (31) in a counter-clockwise direction about 90 degrees, for example, will cause the handle (50) to pivot outward as the locking pin (54) is urged up along the cam face (33) of the circumferential groove, as illustrated in FIG. 11B. The ability of the lockplug assembly to forcibly eject and present the handle (50) for unlatching is a preferred feature because the forced ejection will overcome any resistance of the latch to open caused by environmental factors (e.g., freezing of the latch components, accumulation of debris in the latch, etc.), which may prevent the latch from operating successfully.

Figure 7D:
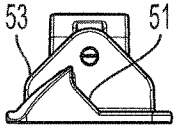
FIG. 7D shows a rear view of the handle of FIG. 7A.
Figure 7E:
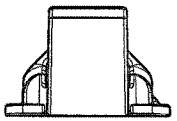
FIG. 7E shows a front view of the handle of FIG. 7A.
Figure 7F:
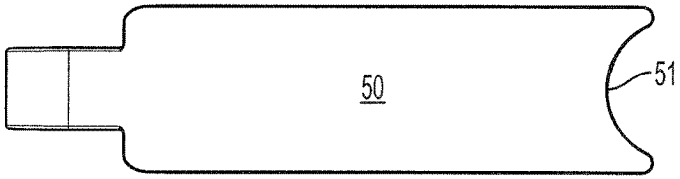
FIG. 7F shows a bottom view of the handle of FIG. 7A.
Figure 7G:
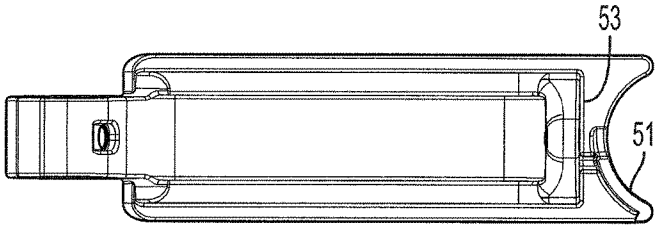
FIG. 7G shows a top view of the handle of FIG. 7A.
Figure 7A:
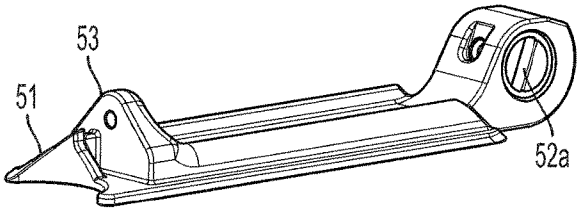
FIG. 7A shows a perspective view of a handle of the compression latch assembly illustrated in FIG. 1A.
Figure 7B:
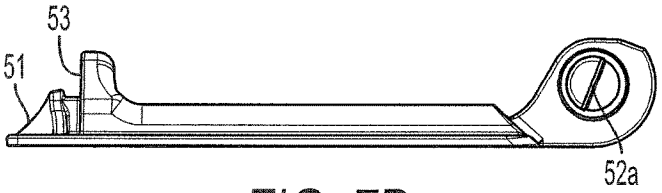
FIG. 7B shows a left side view of the handle of FIG. 7A.
Figure 7C:
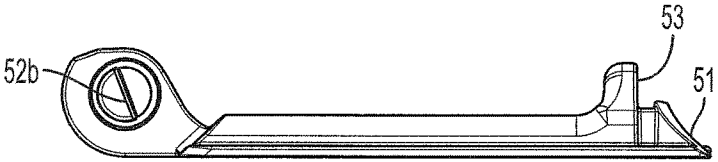
FIG. 7C shows a right side view of the handle of FIG. 7A.
Figure 11D:
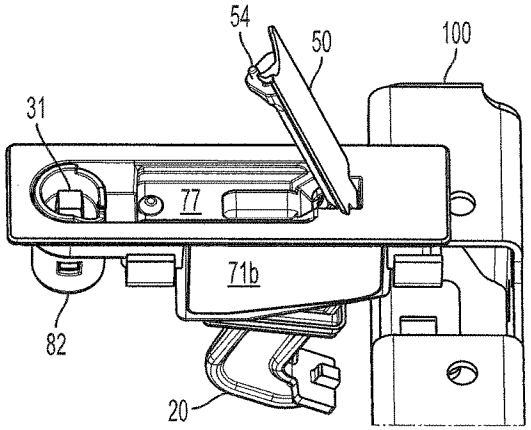
FIG. 11D shows a perspective view of the exposed face of the compression latch assembly illustrated in FIG. 1A in combination with a striker plate in an unlatched condition.
Figure 11C:
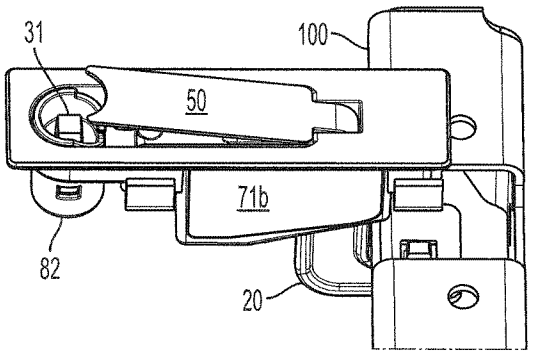
FIG. 11C shows a perspective view of the exposed face of the compression latch assembly illustrated in FIG. 1A in combination with a striker plate in which the handle is in a released condition and the lockplug is in an initial position.

Upon lifting the handle (50), the user may grasp the handle (50) and release the lockplug driver (31). Because the torsion spring (39) attached to the lockplug (30) is biased in a clockwise direction, the lockplug assembly will rotate back to the initial starting position, as illustrated in FIG. 11C. Lifting the handle (50) will actuate the rotating pawl assembly, as illustrated in FIG. 11D. Returning the handle (50) to its original position will force the locking pin (54) against the ramp portion (35) of the circumferential groove urging the lockplug (30) to rotate in a counter-clockwise direction, until the locking pin (54) reaches the bottom of the ramp (35). Upon passing the ramp (35), the locking pin (54) will return to the captive notch (34) when the torsion spring (39) rotates the lockplug (30) clockwise back to the initial position. To prevent tampering with the locking feature, the handle (50) may be provided with a security wall (51) to deny access to the handle pin (54) and prevent unauthorized entry by forcibly bending or breaking the handle pin (54). The security wall (51) may include a rounded leading edge (as seen in FIGS. 7F and 7G), so as not to interfere with access to the lockplug driver (31).

Actuating a latch according to the present invention may be accomplished by rotating the handle (50) about a pivot point (110) into and out of an exterior well (77) of the housing (70). Rotating the handle (50) out of the exterior well (77) will preferably cause the hook (20) to first slide away from the latch body and then rotate towards the latch body. Therefore, the trajectory of the hook (20) during actuation, preferably, includes linear movement and arcuate movement. The linear translation of the hook (20) may provide the compression stroke, i.e., compression of the panel to the frame when set to the latched position. When unlatched, the linear translation following by the arcuate movement moves the hook (20) away from the striker plate, allowing the panel to be swung from a closed position to an open position.

Referring to the embodiment illustrated in FIGS. 12A to 12F, the handle (50) attached to the two cranks (58*a* and 58*b*) rotate about a common pivot point (110) forming a lever. As described above, a drive shaft (60) may be coupled on either end to one of the cranks (58*a* and 58*b*) and extends through an arced slot (78) in the second compartment (74) of the housing (70) and a primary guide slot (28*a*) defined by the hook (20). The secondary guide slots (28*b* and 28*c*) also defined by the hook (20) may accommodate the two knurled pin guides (73*a* and 73*b*). The two knurled pin guides (73*a* and 73*b*) may be pressed into the housing (70) and secure the housing box (80) to the housing (70). The knurled pin guides (73*a* and 73*b*) may remain static to limit and control the rotational movement of the hook (20). The housing box (80) may be rigidly fixed in the housing (70) to support the hook (20) and provide a bearing surface for the hook (20), as well as to reduce friction during movement.

Figure 12D:
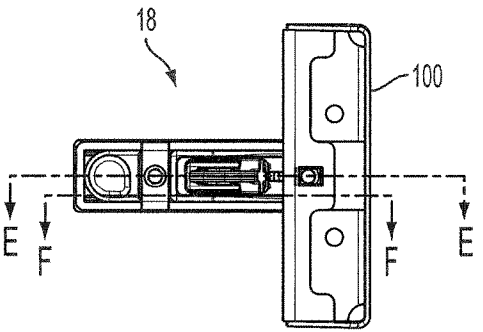
FIG. 12D shows an overhead plan view of the compression latch assembly illustrated in FIG. 1A in combination with a striker plate in an unlatched condition.
Figure 12E:
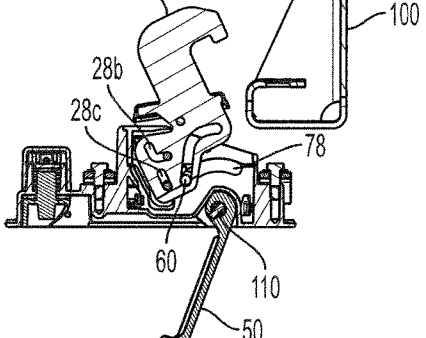
FIG. 12E shows a cross-sectional side view of the compression latch assembly and striker plate of FIG. 12D along line E-E.
Figure 12F:
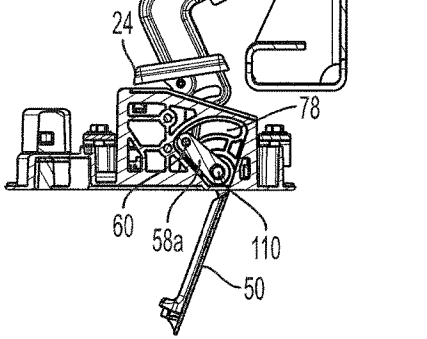
FIG. 12F shows a cross-sectional side view of the compression latch assembly and striker plate of FIG. 12D along line F-F.

Rotation of the handle (50), rotates the cranks (58*a* and 58*b*) and the drive shaft (60) sweeps through the arced slot (78). During the sweep, the drive shaft (60) simultaneously travels through the primary guide slot (28*a*) of the hook (50). Initially, the sweeping movement of the drive shaft (60) combined with the arc of primary guide slot (28*a*) results in a linear movement of the hook (20) up and away from the striker plate (100). Further sweeping of the drive shaft (60) results in a counter-clockwise rotational movement of the Hook (01) away from the striker plate (100), as seen in FIGS. 12D through 12F. Rotation of the handle (50) in the reverse direction will return the latch to its original closed position, wherein the hook (20) engages the striker plate (100). Upon pushing the handle (50) into the exterior well (77) of the housing (70), the handle (50) may be locked due to the interaction between the locking pin (54) and the circumferential groove on the lockplug (30), as described above. Once the handle (50) is secured within the exterior well (77) of the housing (70), the hook (50) cannot translate linearly or rotate, even if external forces are applied to the hook.

Various embodiments of the present invention may be provided with sealing features to prevent liquids and debris from flowing through the panel, into the latch, or both. Latches according to the present invention may be applied to door panels where there is a need to prevent dust and liquid ingress into a sealed compartment (interior of door). A gasket (90) as described above, for example, is one feature that may be combined with a latch according to the present invention to prevent liquids and debris from entering the interior side of a panel from the exterior side.

Various embodiments of the present invention may also be used on doors where there is no sealed compartment and the rotating pawl assembly is exposed to the environment. In such applications, latches according to the present invention may prevent the ingress of dust/debris into the latch which may impair latch functionality. Such features may include the use of O-rings (59*a* and 59*b*) around the bearing surfaces (55) of the cranks (58*a* and 58*b*) because the exterior well (77) of the housing (70) is open to the front of the latch where the handle (50) and lockplug (30) are situated. The handle (50) must pass through an opening in the housing (70) in order to attach to the cranks (58*a* and 58*b*) in the second compartment (74) of the housing (70), which is one area of potential ingress. Providing each crank (58*a* and 58*b*) with an O-Ring (59*a* and 59*b*) seals the potential ingress between the exterior well (77) and the second compartment (74) of the housing (70) while permitting rotation of the handle actuator assembly.

Another area of potential ingress is located within the lockplug assembly because the lockplug tail section (32) may be inserted through an opening in the first compartment (72) of the housing (70). Another O-ring (37) may be provided around the tail section (32) to provide a seal. As described above, the tail section (32) may first be inserted through a wear washer (36) and then an opening in the first compartment (72). Upon passing through the opening, the O-Ring (37) may be applied to the tail section (32) prior to the washer (38), torsion spring (39), and bearing (40). Sealing may be achieved through the union between the O-ring (37), first compartment (72), and tail section (32). Pressure may applied to the O-ring (37) from the torsion spring (39) through the washer (38). The O-ring (37) may provide a seal against dust and liquid entry while permitting the rotation of the lockplug assembly to release and secure the handle (50). The first compartment (72) of the housing may also be sealed using the lockplug cap (82) to prevent the ingress of dust/debris into the lockplug assembly from the interior side of the latch.

The second compartment (74) of the housing (70) may also provide potential areas of ingress. For example, where the hook (20) emerges from the bearing surface of the housing box (80), a shoulder (22) of the hook (20), as described above, with a compression gasket (22). When the latch is closed the compression stroke of the latch compresses the compression gasket (22) against the bearing surface of the housing box (80) and prevents dust/liquid ingress into the second compartment (74). Other potential areas of ingress that may be designed to ensure a seal include the perimeters of the side covers (71*a* and 71*b*) and the bearing surface of the housing box (80).

Figure 14:
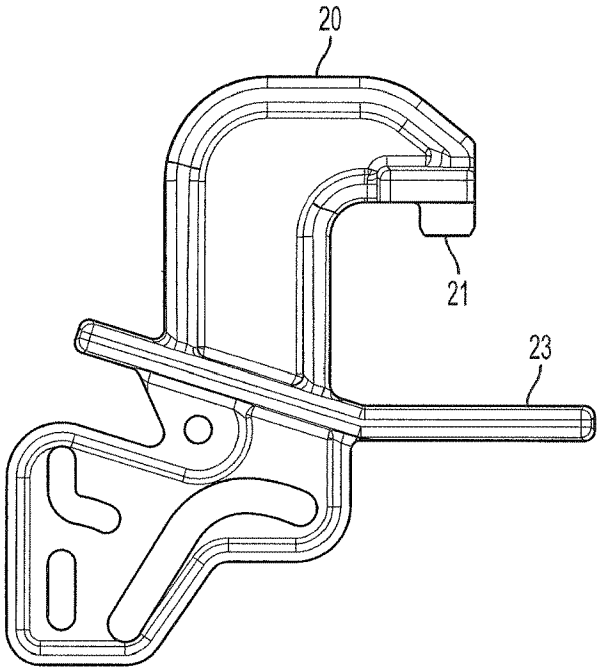
FIG. 14 shows a left side view of a hook of the compression latch assembly illustrated in FIG. 14.
Figure 13:
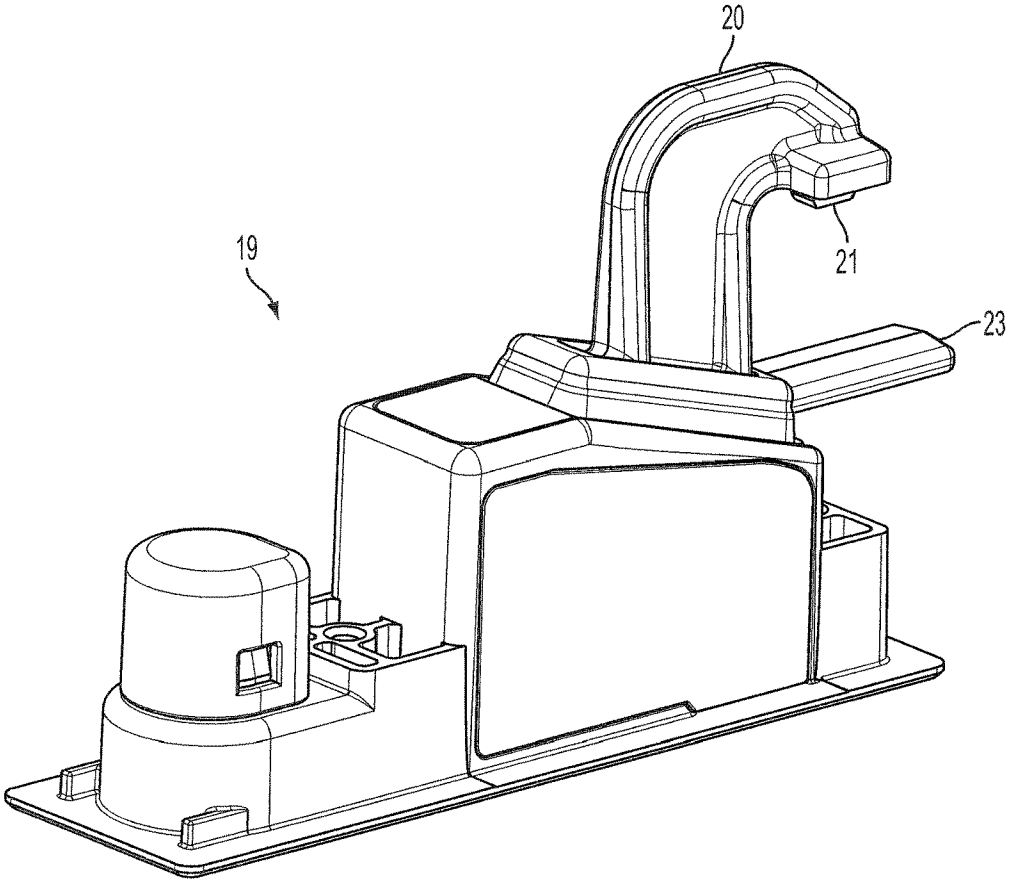
FIG. 13 shows perspective view of a second embodiment of a compression latch assembly according to the invention.
Figures 15A, 15B, 15C, 15D:
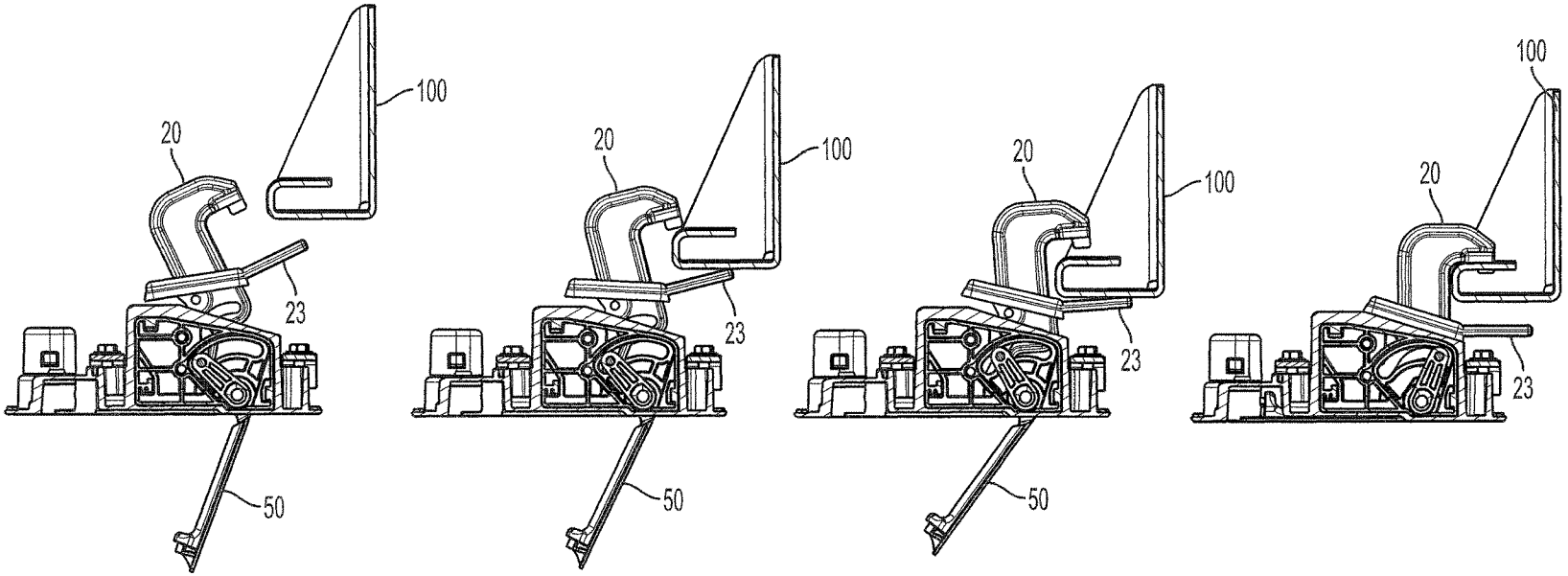
FIG. 15A shows a cross-sectional side view of the compression latch assembly illustrated in FIG. 13 in combination with a striker plate in an unlatched condition.
FIG. 15B shows a cross-sectional side view of the compression latch assembly Illustrated In FIG. 13 in combination with a striker plate in a first intermediate condition.
FIG. 15C shows a cross-sectional side view of the compression latch assembly illustrated in FIG. 13 in combination with a striker plate in a second intermediate condition.
FIG. 15D shows a cross-sectional side view of the compression latch assembly illustrated in FIG. 13 in combination with a striker plate in a latched condition.

Another embodiment of the present invention provides a latch assembly (19), as described above, except that the hook (20) is provided with extension (23) of the shoulder (22) beneath the nose (21), as illustrated in FIGS. 13 and 14. The extension (23) facilitates rotation of the latch when a user pushes a panel in which the latch is mounted to a closed position. Referring to FIGS. 15A to 15D, upon slamming a door panel in which a latch according to present invention is installed, the extension (23) may contact a striker plate (100) prior to the nose (21) due to the rotational position of the hook (20) and the length of the extension (23). The slamming contact may then rotate the hook (20) in a clockwise direction to an intermediate position, as seen in FIG. 15B, initiating the latching stroke. Upon closing the door panel, the hook (20) will be in position and ready to move linearly for compression onto the striker plate (100), as seen in FIG. 15C. At this point the mechanism may not be fully latched, and the compression stroke of the hook (20) may not commence until an operator intervenes. The handle (50) will not be completely depressed into the exterior well (77) of the housing (70) indicating that the latch is not yet in the fully latched condition. The final closing stroke compressing the gasket (24) against the bearing surface of the housing box (80) may require a user to push the handle (50) into the exterior well (77) of the housing (70) to obtain the latched condition, as seen in FIG. 15D.

As described above, a compression latch assembly according to the present invention provides various benefits and advantages. Latches according to the present invention may be easily installed into a cutout in a panel using mounting hardware and provide a seal between the interior environment and exterior environment on either side of the panel in addition to securely locking a door by interaction between a rotating pawl assembly and a strike plate.

Compression latch assemblies according to the present invention may also include sealed compartments. For example, using a combination of O-rings and compressible gaskets to provide a barrier at potential points of ingress for water and debris that, if present within the housing assemblies, may impair operation of the compression latch assembly.

The lockplug assembly and handle actuator assembly incorporated in various embodiments of the present invention may also provide a dual security/actuation feature to prevent unauthorized operation of the compression latch assembly and to assist in the release of a handle. This is achieved, for example, by a combination of two or more of a biased lockplug, a female and/or male lockplug driver that mates with a corresponding key or tool, a circumferential groove around the lockplug to selectively capture and release the handle, a handle pin protruding from a surface of a handle to interact with the circumferential groove of the lockplug, and a security wall on an end surface of the handle to prevent tampering with the handle pin.

Various embodiments of the invention installed in a panel may also include a self-latching feature when a panel is slammed shut. This may be achieved, for example, by the use of a pawl extension that interacts with the strike plate and causes rotation of the pawl.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A compression latch assembly configured for latching a panel separating an interior region from an exterior region, the compression latch assembly comprising:

a housing assembly defining an exterior well open to the exterior region and a compartment extending into the interior region;

a handle actuator assembly having a handle exposed within the exterior well of the housing assembly, a crank coupled to the handle, and a drive shaft coupled to the crank, wherein the handle and the crank rotate about a pivot point within the compartment of the housing assembly to move the drive shaft; and a rotating pawl assembly having a hook defining a slot positioned to receive the drive shaft of the handle actuator assembly, wherein pivotal movement of the handle of the handle actuator assembly with respect to the pivot point actuates the hook by movement of the drive shaft of the handle actuator assembly relative to the slot from a first position within the slot to a second, different position within the slot defined in the hook.

2. The compression latch assembly of claim 1, wherein the housing assembly further defines a second compartment and a lockplug assembly is positioned within the second compartment, the lockplug assembly including a lockplug configured to selectively capture and eject the handle.

3. The compression latch assembly of claim 2, wherein the lockplug has a circumferential guide surface, the handle further includes a locking pin extending from a surface of the handle, and the handle is selectively captured and ejected by interaction between the circumferential guide surface of the lockplug and the locking pin extending from the surface of the handle.

4. The compression latch assembly of claim 2, wherein the lockplug includes a lockplug driver, the lockplug driver including at least one of a male projection and a female recess.

5. The compression latch assembly of claim 4 in combination with a key configured to mate with the at least one male projection and female recess of the lockplug driver.

6. The compression latch assembly of claim 1, wherein the hook includes a shoulder shrouded with a compressible gasket and the compressible gasket contacts a bearing surface of the housing when the compression latch assembly is in a latched condition.

7. The compression latch of assembly claim 1 in combination with mounting hardware.

8. A compression latch assembly configured for latching a panel separating an interior region from an exterior region, the compression latch assembly comprising:

a housing assembly defining an exterior well open to the exterior region, a first compartment, and a second compartment, the first and second compartments extending into the interior region;

a lockplug assembly within the first compartment, the lockplug assembly including a lockplug having a circumferential guide surface, wherein the lockplug is biased towards a locking position;

a handle actuator assembly having a handle exposed within the exterior well of the housing assembly, a locking pin extending from a surface of the handle, a crank coupled to the handle, and a drive shaft coupled to the crank, wherein the handle and the crank rotate about a pivot point within the second compartment of the housing assembly to move the drive shaft, and wherein the handle is selectively captured and ejected by interaction between the circumferential guide surface of the lockplug and the locking pin extending from the surface of the handle; and a rotating pawl assembly having a hook defining a slot positioned to receive the drive shaft of the handle actuator assembly, wherein pivotal movement of the handle of the handle actuator assembly with respect to the pivot point actuates the hook by movement of the drive shaft of the handle actuator relative to the slot from a first position within the slot to a second, different position within the slot defined by the hook.

9. The compression latch assembly of claim 8, wherein the lockplug includes a lockplug driver, the lockplug driver including at least one of a male projection and a female recess.

10. The compression latch assembly of claim 9 in combination with a key configured to mate with the at least one male projection and female recess of the lockplug driver.

11. The compression latch assembly of claim 8, wherein the hook includes a shoulder shrouded with a compressible gasket and the compressible gasket contacts a bearing surface of the housing when the compression latch assembly is in a latched condition.

12. The compression latch of assembly claim 8 in combination with mounting hardware.

13. A compression latch assembly configured for latching a panel to a strike plate, the panel separating an interior region from an exterior region, the compression latch assembly comprising:

a housing assembly defining an exterior well open to the exterior region and a compartment extending into the interior region;

a handle actuator assembly having a handle exposed within the exterior well of the housing assembly, a crank coupled to the handle, and a drive shaft coupled to the crank, wherein the handle and the crank rotate about a pivot point within the compartment of the housing assembly to move the drive shaft; and a rotating pawl assembly including a pawl having a hook and an extension, the hook defining a slot positioned to receive the drive shaft of the handle actuator assembly, wherein pivotal movement of the handle of the handle actuator assembly with respect to the pivot point actuates the hook by movement of the drive shaft of the handle actuator assembly relative to the slot from a first position within the slot to a second, different position within the slot defined in the hook, and wherein the extension contacts the strike plate when the panel is swung toward the interior region and urges the hook towards the strike plate.

14. The compression latch assembly of claim 13, wherein the housing assembly further defines a second compartment and a lockplug assembly is positioned within the second compartment, the lockplug assembly including a lockplug configured to selectively capture and eject the handle.

15. The compression latch assembly of claim 14, wherein the lockplug has a circumferential guide surface, the handle further includes a locking pin extending from a surface of the handle, and the handle is selectively captured and ejected by interaction between the circumferential guide surface of the lockplug and the locking pin extending from the surface of the handle.

16. The compression latch assembly of claim 14, wherein the lockplug is biased towards a locking position.

17. The compression latch assembly of claim 14, wherein the lockplug includes a lockplug driver, the lockplug driver including at least one of a male projection and a female recess.

18. The compression latch assembly of claim 17 in combination with a key configured to mate with the at least one male projection and female recess of the lockplug driver.

19. The compression latch assembly of claim 13, wherein the hook includes a shoulder shrouded with a compressible gasket and the compressible gasket contacts a bearing surface of the housing when the compression latch assembly is in a latched condition.

20. The compression latch assembly of claim 13 in combination with mounting hardware.

* * * * *